US011215180B2

(12) United States Patent
Kösters et al.

(10) Patent No.: US 11,215,180 B2
(45) Date of Patent: Jan. 4, 2022

(54) METHOD AND PUMP ARRANGEMENT FOR EVACUATING A CHAMBER

(71) Applicant: Sterling Industry Consult GmbH, Itzehoe (DE)

(72) Inventors: Heiner Kösters, Itzehoe (DE); Jörg Temming, Kölln-Reisiek (DE); Daniel Kühlein, Quickborn (DE)

(73) Assignee: Sterling Industry Consult GmbH, Itzehoe (DE)

( * ) Notice: Subject to any disclaimer, the term of this patent is extended or adjusted under 35 U.S.C. 154(b) by 667 days.

(21) Appl. No.: 14/408,995

(22) PCT Filed: Jun. 12, 2013

(86) PCT No.: PCT/EP2013/062179

§ 371 (c)(1),
(2) Date: Dec. 18, 2014

(87) PCT Pub. No.: WO2014/001090

PCT Pub. Date: Jan. 3, 2014

(65) Prior Publication Data

US 2015/0152871 A1 Jun. 4, 2015

(30) Foreign Application Priority Data

Jun. 28, 2012 (EP) ..... 12174031

(51) Int. Cl.
*F04D 15/00* (2006.01)
*F04D 1/06* (2006.01)
(Continued)

(52) U.S. Cl.
CPC ..... *F04C 28/06* (2013.01); *F04C 2/10* (2013.01); *F04C 14/08* (2013.01); *F04C 23/005* (2013.01);
(Continued)

(58) Field of Classification Search
CPC ..... F04B 25/00; F04B 41/06; F04B 49/22; F04B 49/24; F04B 2205/01;
(Continued)

(56) References Cited

U.S. PATENT DOCUMENTS 4,850,806 A * 7/1989 Morgan ..... F04B 37/14 417/53
5,040,949 A 8/1991 Crinquette et al.
(Continued)

FOREIGN PATENT DOCUMENTS

DE 19748385 A1 * 5/1999 ..... F04C 18/084
EP 0343914 A1 11/1989
(Continued)

OTHER PUBLICATIONS

International Preliminary Report on Patentability dated Dec. 31, 2014 (PCT/EP2013/062179).
(Continued)

*Primary Examiner* — Dominick L Plakkoottam
*Assistant Examiner* — Charles W Nichols
(74) *Attorney, Agent, or Firm* — Alix, Yale & Ristas, LLP

(57) ABSTRACT

A method for evacuating a chamber employs a pump arrangement composed of a booster pump and of a downstream forepump is connected to the chamber. The booster pump is accelerated, gas from the chamber is introduced into the booster pump, such that from the booster pump there is temporarily extracted an excess power which exceeds the power provided by the drive of the booster pump. The gas is discharged through a bypass valve while the outlet pressure of the booster pump lies above a predefined threshold value, and the gas is directed to the forepump when the outlet pressure of the booster pump has fallen below the
(Continued)

threshold value. The gas supplied by the booster pump is compressed by means of the forepump.

15 Claims, 4 Drawing Sheets

(51) Int. Cl.

| | |
|---|---|
| ***F04C 2/10*** | (2006.01) |
| ***F04C 14/08*** | (2006.01) |
| ***F04C 28/06*** | (2006.01) |
| ***F04C 28/02*** | (2006.01) |
| ***F04C 23/00*** | (2006.01) |
| ***F04C 25/02*** | (2006.01) |
| *F04C 18/08* | (2006.01) |
| *F04C 18/16* | (2006.01) |

(52) U.S. Cl.
CPC ..... *F04C 25/02* (2013.01); *F04C 28/02* (2013.01); *F04C 18/084* (2013.01); *F04C 18/086* (2013.01); *F04C 18/16* (2013.01); *F04C 2220/30* (2013.01)

(58) Field of Classification Search
CPC ..... F04B 2205/05; F04C 14/08; F04C 18/16; F04C 18/084; F04C 18/086; F04C 23/00–006; F04C 25/02; F04C 28/02; F04C 28/06; F04C 28/06524; F04C 28/26; F04C 2220/30; F04C 2270/18; F04C 2270/21; F04C 2270/44; F04D 1/06; F04D 15/0066; F04D 15/022; F04D 25/16; F04D 27/005; F04D 27/0207; F04D 27/0215; F04D 27/0223; F04D 27/0269; F04D 28/02; F04D 28/06
See application file for complete search history.

(56) References Cited

U.S. PATENT DOCUMENTS

| | | | | |
|---|---|---|---|---|
| 5,575,853 | A * | 11/1996 | Arami | C23C 16/4412 118/708 |
| 6,004,109 | A | 12/1999 | Gebele et al. | |
| 2005/0031468 | A1* | 2/2005 | Kawaguchi | F04B 49/06 417/410.1 |
| 2008/0089793 | A1* | 4/2008 | Coles | F04B 41/06 417/251 |
| 2010/0047080 | A1* | 2/2010 | Bruce | F04B 49/06 417/45 |
| 2011/0293459 | A1* | 12/2011 | Kirkland | F04C 2/16 418/201.1 |
| 2012/0219443 | A1 | 8/2012 | Neel | |

FOREIGN PATENT DOCUMENTS

| | | | |
|---|---|---|---|
| JP | 2010138725 | A | 6/2010 |
| JP | 2010151538 | A | 7/2010 |

OTHER PUBLICATIONS

International Search Report dated Oct. 30, 2013 (PCT/EP2013/062179).

* cited by examiner

METHOD AND PUMP ARRANGEMENT FOR EVACUATING A CHAMBER

BACKGROUND

The invention relates to a method and a pump arrangement for evacuating a chamber. The pump arrangement, which is connected to the chamber, comprises a booster pump and a downstream forepump.

In many technical applications, it is nowadays required for a chamber to be evacuated to a predefined vacuum within a short time. One example is lock chambers through which products are introduced into a vacuum chamber. The products may be, for example, mass-produced articles such as solar cells, displays etc. for which individual manufacturing steps are carried out in the vacuum chamber. It is sought for such products to be introduced into the vacuum chamber with ever shorter cycle times. It is not uncommon for lock chambers with a volume of a few hundred liters to have to be evacuated to a pressure of less than $10^{-2}$ mbar in considerably less than 10 seconds.

For the evacuation of such lock chambers, use is normally made of pump arrangements composed of two series-connected pumps, wherein the first pump is normally referred to as booster pump, and the downstream pump is normally referred to as forepump. The series connection of two pumps is expedient because, according to the ideal gas law (pressure*volume=constant; assuming constant temperature), the forepump can be designed for a significantly smaller volume flow than the booster pump.

If, however, a lock chamber is to be evacuated proceeding from atmospheric pressure within a very short time, the booster pump initially delivers a large volume flow at high pressure, with the result that a large volume flow arrives at the outlet of the booster pump. Forepumps that can handle such a large volume flow are cumbersome and expensive.

SUMMARY

The invention is based on the object of providing a method and a pump arrangement which permit the fast evacuation of a chamber with reduced outlay in terms of apparatus. Taking the stated prior art as a starting point, the object is achieved by means of the features of the independent claims. The subclaims relate to advantageous embodiments.

In the method according to the invention, the booster pump is initially accelerated. Gas from the chamber to be evacuated is then introduced into the booster pump, such that from the booster pump there is temporarily extracted an excess power which exceeds the power provided by the drive of the booster pump. The gas that is delivered to the outlet of the booster pump is discharged through a bypass valve for as long as the outlet pressure in the booster pump lies above a predefined threshold value. The gas is conducted onward to the forepump when the outlet pressure of the booster pump has fallen below the threshold value. The gas supplied by the booster pump is compressed by means of the forepump.

A few expressions will firstly be explained. The expressions "booster pump" and "forepump" illustrate the sequence of the pumps in the pump arrangement. Said expressions do not yield a limitation with regard to the configuration of the pump.

The invention has recognized that, as a result of the acceleration of the booster pump and the subsequent extraction of the excess power, it is possible for the gas from the chamber to be delivered to the outlet of the booster pump at such a high pressure that the gas can be discharged directly, bypassing the forepump. Only when the evacuation process has progressed to such an extent that the booster pump is no longer capable of compressing the gas to the corresponding pressure is the forepump additionally used for the further compression. By means of the invention, it is possible for the forepump to be designed not only for a smaller volume flow but also for a small mass flow than the booster pump.

In general, atmospheric pressure prevails at the outlet of the bypass valve. In this case, the threshold value corresponds to the atmospheric rusher. The gas thus emerges through the bypass valve for as long as the outlet pressure of the booster pump lies above atmospheric pressure. At its peak, the outlet pressure of the booster pump may be at least 1 bar, preferably at least 2 bar, more preferably at least 3 bar above atmospheric pressure. The gas compressed by means of the forepump may likewise be discharged at atmospheric pressure to the environment.

At the start of the evacuation process, atmospheric pressure generally prevails in the chamber, such that the evacuation process begins at atmospheric pressure. Before the beginning of the evacuation process, the inlet of the booster pump may be closed, such that no gas from the chamber can enter into the booster pump. The evacuation process then begins at the time at which gas is introduced into the booster pump.

In order to be able, at the beginning of the evacuation process, to deliver a large volume flow at high pressure (for example atmospheric pressure), the booster pump must provide a high compression power. The high compression power is provided by virtue of the fact that, during the evacuation process, there is temporarily extracted from the booster pump more compression power than is provided by the drive of the booster pump. The excess power that exceeds the drive power is extracted from the kinetic energy of the booster pump. The booster pump is thus braked, and the rotational speed of the pump decreases.

Within the context of the invention, the power extracted in the booster pump may be considerably higher than the drive power. It is for example possible that, at its peak, the excess power is more than 50%, preferably more than 100%, more preferably more than 200%, of the drive power. In the case of an excess power of 100%, the compression power is twice as great as the drive power.

It may also be provided that the excess power is extracted not only instantaneously but rather over a certain time period. If the evacuation process begins at the time at which the pressure in the chamber falls below the outlet pressure, and ends at the time at which the final pressure in the chamber is reached, the time period during which excess power is extracted may extend for example over 10%, preferably over 20%, more preferably over 50% of the evacuation process. The rotational speed of the booster pump may, as a result of the extraction of the excess power, be reduced by at least 5%, preferably at least 10%, more preferably at least 25%.

In order that it is possible for excess power to be extracted from the pump to such an extent, the pump must, before the beginning of the evacuation process, be placed into a state in which a correspondingly large amount of kinetic energy is available. The pump is thus accelerated before the beginning of the evacuation process.

To be able to provide adequate kinetic energy, the rotational speed of the booster pump at the start of the evacuation process is preferably higher than 8000 rpm, more preferably higher than 10,000 rpm, more preferably higher than 12,000 rpm. The diameter of the parts that are in rotation is preferably greater than 5 cm, more preferably greater than 10 cm, more preferably greater than 20 cm.

If the gas from the chamber is introduced into the booster pump at substantially atmospheric pressure, the booster pump is subjected to an abrupt load. Some pump types which have hitherto been used as booster pumps, such as for example Roots pumps, are generally less suitable for accommodating such abrupt loads. In one advantageous embodiment, as a booster pump, use is made of a screw-type pump, the preferred configuration of which is explained in more detail below. The forepump may for example be a conventional liquid-ring vacuum pump.

With the method according to the invention, it is possible for a chamber with the volume of more than 100 L to be evacuated from atmospheric pressure to a pressure of less than $10^{-2}$ mbar in less than five seconds. This possibility is of particular interest within the context of lock applications where a lock chamber of said order of magnitude must be repeatedly evacuated with a short cycle time. Atmospheric pressure prevails at the inlet of the lock chamber, which means that atmospheric pressure is also assumed in the lock chamber when the inlet is opened in order to introduce a component into the lock chamber. The outlet of the lock chamber is adjoined by a vacuum chamber in which the pressure is for example $10^{-2}$ mbar. The lock chamber must thus be evacuated to said pressure before the outlet can be opened in order to transfer the component into the vacuum chamber.

If the cycle time of the lock is for example 10 seconds, then the time period in which excess power is extracted from the booster pump may be for example one second, while the rest of the cycle time is utilized to accelerate the booster pump to the starting rotational speed again. In more general terms, the time period of the extraction of excess power is preferably at least 5%, more preferably at least 10% of the cycle time. During at least 30%, preferably at least 50%, more preferably at least 70% of the cycle time, the power extracted from the booster pump is lower than the drive power, such that the booster pump is accelerated.

The invention also relates to a pump arrangement. The pump arrangement comprises a booster pump and a forepump, wherein the outlet of the booster pump is connected to the inlet of the forepump. Between the booster pump and the forepump, there is arranged a bypass valve by means of which gas delivered by means of the booster pump can be discharged while bypassing the forepump. The pump arrangement also comprises a control unit which is configured so as to output a control signal if the rotational speed of the booster pump lies above a predefined rotational speed threshold value. The rotational speed threshold value is such that, after the respective rotational speed is exceeded, the booster pump is ready for the extraction of excess power. Such a pump arrangement is suitable for evacuating a chamber in a short time in accordance with the method according to the invention.

The control signal may be transmitted to a controller of the chamber to be evacuated, in order to indicate that the booster pump is ready for the next evacuation process. The controller of the chamber may thereupon open the inlet of the booster pump via which the booster pump is connected to the chamber. The gas from the chamber then enters into the booster pump, and the chamber is quickly evacuated. As the gas enters the booster pump, the load increases abruptly, such that the rotational speed of the booster pump decreases.

The control unit of the booster pump may furthermore be configured to accelerate the booster pump before the beginning of the evacuation process such that the rotational speed threshold value is exceeded. To provide an adequate amount of kinetic energy for the extraction of the excess power, the rotational speed threshold value preferably lies above the delivery rotational speed of the booster pump. The delivery rotational speed denotes the rotational speed which is assumed as a steady state when the induction pressure is 100 mbar. The drive power corresponds, at the delivery rotational speed, to the pump power, which means that the rotational speed of the booster pump remains constant. The rotational speed threshold value may be higher, by 10%, preferably by 30%, more preferably by 50%, than the delivery rotational speed. In absolute numbers, the rotational speed threshold value may for example be at least 8000 rpm, preferably at least 10,000 rpm, more preferably at least 12,000 rpm. Normally, booster pumps used for an application within the context of the invention are operated at considerably lower rotational speeds. A rotational speed of 6000 rpm is generally not exceeded during the operation of such booster pumps. In the case of the method according to the invention, too, the booster pump can be accelerated beyond the delivery rotational speed.

The arrangement according to the invention may furthermore encompass the chamber to be evacuated. The control unit of the arrangement may for this purpose be designed to open the inlet of the pump, via which the booster pump is connected to the chamber, after the rotational speed threshold value has been exceeded. Furthermore, the control unit may be configured to keep the inlet closed while the booster pump is accelerated.

In one advantageous embodiment, as a booster pump, use is made of a screw-type pump in which the screws of two threads engage with one another in such a way that the gas is conveyed from a suction side to a pressure side between the thread turns. To be able to withstand the stated high rotational speeds, the screws preferably have in each case two threads, such that the forces that arise in the longitudinal direction of the screws cancel one another out. The threads of the screws are preferably of double-start configuration. Here, in a radial direction, point-symmetry of the screws may exist such that the screws are imaged into themselves by a rotation of 180° about the longitudinal axis. The diameter of the screws is preferably greater than 10 cm, more preferably greater than 15 cm, more preferably greater than 20 cm, such that the screws, as a whole, have approximately the above-stated dimensions.

In order that the screw-type pump can accommodate the large volume flow required in the case of booster pumps, the inlet opening is preferably larger than 60%, more preferably larger than 80%, more preferably larger than 100% of the cross-sectional area of a screw. To keep leakage losses low, it is provided that, close to the pressure side, the radial spacing between the housing of the pump and the thread of the screw is as small as possible (radial minimum spacing), for example less than 0.2 mm, preferably less than 0.1 mm.

In the inlet region, that is to say in particular in that housing portion in which the inlet opening is formed, a suction gap may exist between the thread of the screw and the housing in order to permit a large volume flow into the working chambers of the pumps. The radial diameter of the suction gap is larger, preferably by a factor of 50, more preferably by a factor of 100, more preferably by a factor of 200, than the radial minimum spacing. The suction gap may extend for example of a circumferential angle of at least 15°, preferably at least 30° of the housing. In the longitudinal direction, the suction may extend over at least 20%, preferably at least 30%, more preferably at least 40% of the length of a thread of the screw. The length of the suction gap preferably corresponds to the length of a 360° turn of the thread in said region. The thread thus has a very large pitch in the inlet region. The first 360° turn may extend for example over at least 20%, preferably at least 30%, more preferably at least 40% of the length of the thread. Overall, each thread turn of the double-start thread preferably comprises at least three, more preferably at least four complete 360° turns.

BRIEF DESCRIPTION OF THE DRAWINGS

The invention will be described by way of example below with reference to the appended drawings on the basis of advantageous embodiments. In the drawings.

DETAILED DESCRIPTION

Figure 1:
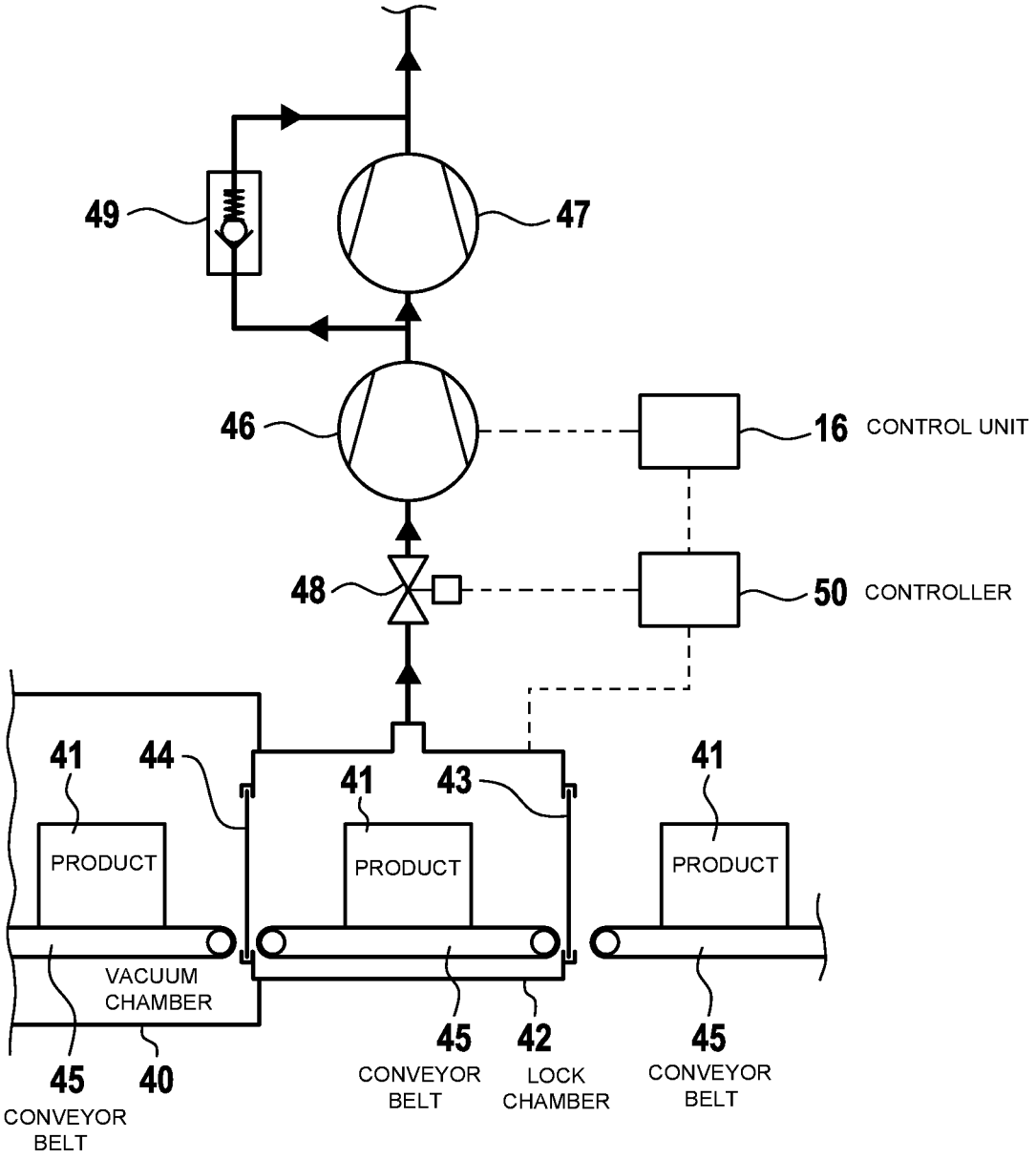
FIG. 1 shows a pump arrangement according to the invention which is connected to a lock chamber.

In a vacuum chamber 40 shown in FIG. 1, certain method steps are performed on a product 41. The product 41, which is illustrated in simplified block form, may be for example a multiplicity of semiconductor components such as for example solar cells or displays. The method step may be a coating process. For the method step, it is necessary for the pressure in the vacuum chamber 40 to be below 0.5 mbar. To keep the vacuum chamber at said pressure, a vacuum pump (not illustrated in FIG. 1) is connected to the vacuum chamber 40.

The vacuum chamber 40 is adjoined by a lock with a lock chamber 42 through which the product 41 is introduced into the vacuum chamber. The lock chamber 42 has an inlet opening and an outlet opening which are provided with sliding doors 43, 44. The sliding doors 43, 44 are controlled by a controller 50 such that they are not both simultaneously open at any time. When the sliding door 43 is open, atmospheric pressure prevails in the lock chamber 42. The lock has a volume of for example 200 l.

When the sliding door 43 is open, the product 41 can be introduced into the lock chamber 42 by means of conveyor belts 45. After the sliding door 43 has subsequently been closed again, the lock chamber 42 is evacuated by means of a pump arrangement connected to the lock chamber 42, such that the pressure in the lock chamber 42 corresponds to the pressure of less than 0.5 mbar prevailing in the vacuum chamber 40. After the completion of the evacuation process, the sliding door 44 is opened, and the product 41 is introduced into the vacuum chamber 40 by means of the conveyor belts 45. The sliding door 44 is subsequently closed again, the lock chamber 42 is brought to atmospheric pressure, and the sliding door 43 is opened. A cycle in the lock is thus completed. The cycle time of the cycle is approximately 10 seconds.

For the evacuation process itself, by means of which the pressure in the lock chamber is reduced from atmospheric pressure to a final pressure of less than 0.5 mbar, a time period is available which is considerably shorter than the cycle time. The evacuation process may extend for example over a time period of five seconds.

To be able to evacuate a lock of this volume in such a short time, a powerful pump arrangement is required which in particular has a high suction capacity across the entire pressure range between atmospheric pressure and final pressure. This is provided by the pump arrangement according to the invention, in which, as per FIG. 1, a screw-type pump as a booster pump 46 and a liquid-ring vacuum pump as a forepump 47 are connected in series. The liquid-ring vacuum pump is of conventional configuration, such that a detailed description is not necessary.

To start the evacuation process, the booster pump 46 is initially accelerated to a rotational speed considerably higher than the delivery rotational speed. A valve 48 arranged between the booster pump 46 and the lock chamber 42 is closed, such that no gas from the lock chamber 42 can enter into the inlet of the booster pump 46. The booster pump 46 is thus not under load, such that a relatively low drive power is sufficient to accelerate the booster pump 46.

When the booster pump 46 has been accelerated to such an extent that a predefined rotational speed threshold value is exceeded, a control unit 16 of the booster pump 46 transmits a control signal to the controller 50 of the lock chamber. The controller 50 is thus provided with the information that the booster pump 46 is ready for the next evacuation process. When the lock chamber 42 is also ready for the next evacuation process, the controller 50 can open the valve 48 such that the booster pump 46 can induct air from the lock chamber 42. The air is delivered, and in the process compressed, by the booster pump 46 such that a pressure considerably higher than atmospheric pressure prevails at the outlet of the booster pump 46. At its peak, a pressure of 3 bar above atmospheric pressure may for example prevail at the outlet of the booster pump 46.

Between the forepump 47 and the booster pump 46 there is arranged a bypass valve 49, at the outlet of which atmospheric pressure prevails. The bypass valve 49 is configured as an overpressure valve, such that the compressed gas from the outlet of the booster pump 46 automatically exits via the bypass valve 49 for as long as the pressure at the outlet of the booster pump 46 lies above atmospheric pressure. If the pressure at the outlet of the booster pump 46 falls below atmospheric pressure, the bypass valve 49 closes. The gas is then taken on by the forepump 47 and compressed further such that said gas can be discharged at atmospheric pressure to the environment.

The closer the pressure in the lock chamber 42 comes to the final pressure, the lower the pressure between the booster pump 46 and the forepump 47 also becomes. The forepump 47 is configured such that it can compress the gas from said pressure to atmospheric pressure.

During such an evacuation process, the booster pump 46 is subjected to particularly high loads. When the valve 48 is opened, the air flow entering the booster pump 46 generates an abrupt load. Furthermore, as a result of the entry of a large volume flow at atmospheric pressure, a high compression power is demanded of the booster pump 46. Said compression power exceeds the drive power of the booster pump 46, which means that an excess power is extracted from the booster pump 46. The excess power is gained from the kinetic rotational energy of the booster pump 46, which means that the rotational speed of the booster pump 46 decreases in said phase.

To be able to provide adequate kinetic rotational energy, the booster pump 46 is accelerated to a high rotational speed of higher than 10,000 rpm before the beginning of the evacuation process. As a result of the extraction of the excess power, the rotational speed decreases within one second to 9000 rpm. The remaining cycle time is utilized to accelerate the booster pump 46 to the original rotational speed again. In this phase, the drive power is consequently higher than the compression power extracted from the booster pump 46.

The booster pump 46 which firstly withstands the loads at the beginning of the evacuation process and which secondly has the required suction capability across the entire pressure range is described below.

Figure 2:
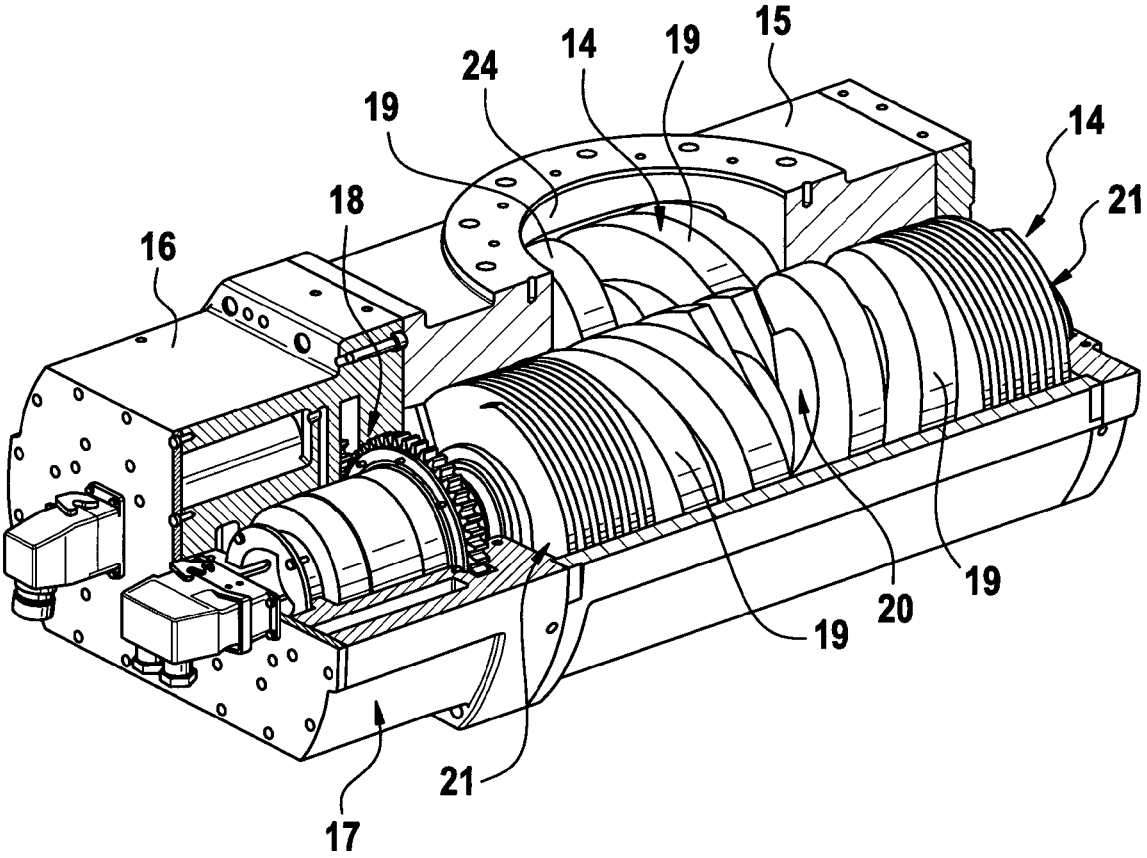
FIG. 2 shows a perspective, partially cut-away illustration of a screw-type pump suitable for the arrangement according to the invention.

The screw-type pump which is suitable as a booster pump comprises, as per FIG. 2, two screws 14 which are accommodated in a pump housing 15. Owing to the pump housing 15 not being illustrated in its entirety, one of the screws 14 is visible over the entire length, whereas the other screw 14 is largely hidden by the pump housing 15. The two screws 14 engage with one another, which means that the thread projections of one screw 14 engage into the depression between two thread projections of the other screw 14.

The pump comprises a control and drive unit 16 in which, for each of the screws 14, there is arranged an electronically controlled drive motor 17. The electronic controller of the drive motors 17 is set up such that the two screws 14 run entirely synchronously with respect one another, without the thread projections of the screws 14 making contact. For additional security against damage to the screws 14, the two screws 14 are in each case equipped with a gearwheel 18. The gearwheels 18 mesh with one another and generate positive coupling of the two screws 14 in the event of failure of the electronic synchronization of the screws 14.

Each screw 14 is equipped with two threads 19, such that the pump has a total of four threads 19. The threads 19 extend in each case from a suction side 20 in the centre of the screw 14 to a pressure side 21 at the outer ends of the screw 14. The two threads of a screw 14 are oriented in opposite directions such that they work from the suction side 20 toward the pressure side 21.

Each of the threads 19 comprises a first thread turn 22 and a second thread turn 23. The threads 19 are thus of double-start form in the sense that the thread turns 22, 23 are interlaced with one another such that they together form a double-helix-like form. The two thread turns 22, 23 are formed such that the threads 19 are symmetrical in a radial direction. The screw 14 furthermore has symmetry in a longitudinal direction when the screw 14 is viewed from the pressure side of the first thread 19 to the pressure side of the second thread 19.

The threads 19 are configured such that a larger volume is enclosed between two adjacent thread projections in the region of the suction side 20 than in the region of the pressure side 21. The volume of the working chambers, which corresponds to the volume enclosed between the thread projections, thus decreases from the suction side to the pressure side, such that gas contained in the working chamber is compressed on the path from the suction side to the pressure side.

The housing 15 of the pump is provided with an inlet opening 24 which is arranged so as to provide access to the suction side 20 of all four threads 19. To permit a large volume flow into the pump, the inlet opening 24 has a large cross section. In the exemplary embodiment, the cross-sectional area of the inlet opening 24 is larger than the circular contour spanned by a screw 14.

To further improve the volume flow into the working chambers, there is formed on the housing 15 of the pump a suction gap 25 which adjoins the inlet opening 24 and which follows the contour of the screw 14 in the circumferential direction. In the longitudinal direction, the suction gap 25 extends over approximately half of the length of the thread 19 between the suction side 20 and the pressure side 21. In the circumferential direction, the dimensioning of the suction gap 25 varies with the inlet opening; the further the inlet opening 24 extends to the side at the respective point, the shorter is the extent of the suction gap 25 in the circumferential direction at said point. At the widest point of the inlet opening 24, the suction gap 25 extends over a circumferential angle of approximately 45°. In the region which the inlet opening 24 no longer covers the suction gap 25, the suction gap 24 extends over a circumferential angle of approximately 120°. The dimension of the suction gap 25 in the radial direction corresponds to the spacing between the pump housing 15 and the contour of the screw 14 in said region. Said spacing lies in the range of approximately 10 mm.

As a result of the suction gap, the gas is no longer restricted to entering the working chambers in a radial direction, and instead the gas can also move into the working chamber across a thread projection and through the suction gap. The volume flow into the working chambers is further increased in this way.

A further contribution to the increase of the volume flow into the working chamber is achieved by virtue of the fact that there is a spacing between the suction side 20 of the first thread 19 of a screw 14 and the suction side 20 of the second thread 19 of the screw 14. In this way, in the centre of the screw 14, a space is left free through which the gas can also enter into the working chamber in a radial direction.

The region in which the suction gap 25 extends (=first housing portion 26) serves for the filling of the working chambers. In the adjoining second housing portion 27, the spacing between the housing and the contour of the screw 14 is as small as is technically possible (radial minimum spacing). The compression takes place in the second housing portion, and a leakage flow from one working chamber into the next working chamber is undesirable.

A transition edge 28 is formed at the transition from the first housing portion 26 to the second housing portion 27. The transition edge 28 extends in a circumferential direction over the entire section 25 and defines the transition from the suction gap 25 to the second housing portion 27, in which the radial minimum spacing exists between the housing 15 and screw 14.

The compression begins when the working chamber has passed into the second housing portion, that is to say when the thread projection which delimits the working chamber toward the suction side has formed a closure with the transition edge 28. The transition edge 28 is arranged such that the formation of a closure between the thread projection and the transition edge 28 takes place at a time at which the working chamber still has its maximum volume.

As viewed in the circumferential direction, the transition edge 28 encloses with the transverse direction an angle smaller than the gradient of the thread projection which forms a closure with the transition edge 28. It is achieved in this way that the formation of a closure between the thread projection and the transition edge 28 does not take place abruptly but rather extends over a short time period. The operating noise of the pump is reduced in this way.

The actual volume compression takes place in a short portion of the thread directly after the closure of the working chamber. The adjoining further turns of the thread served for sealing and also effect a thermodynamic compression.

Figure 3:
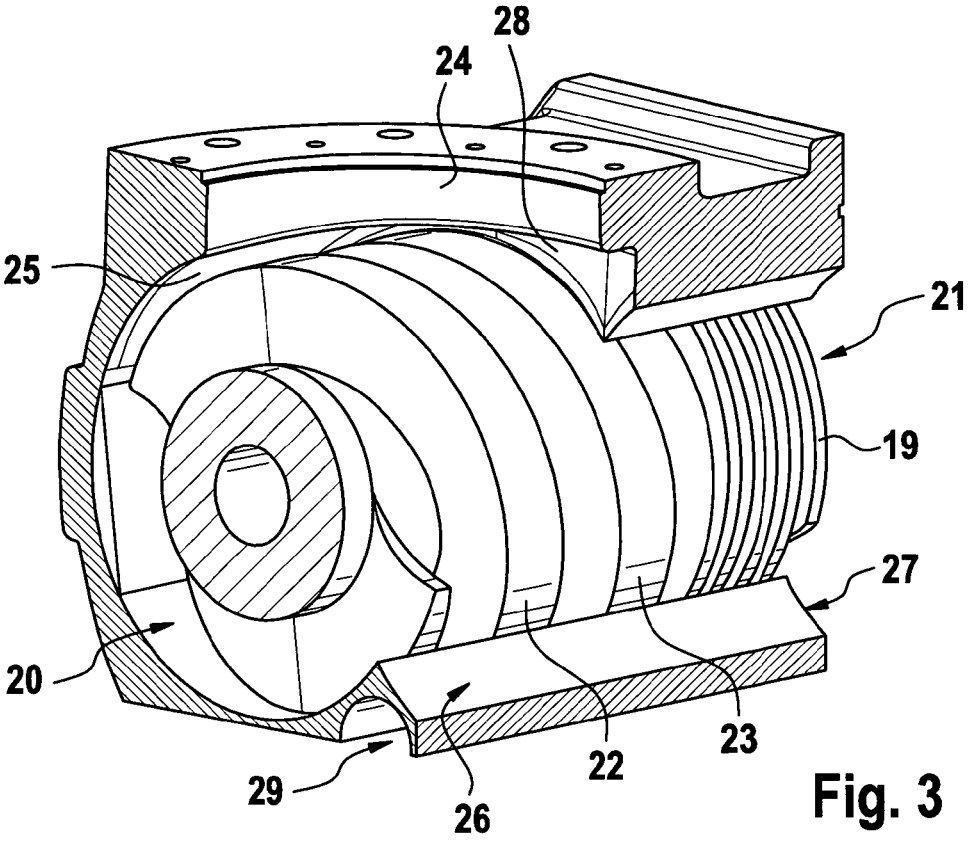
FIG. 3 shows a detail of the pump from FIG. 1 in an enlarged illustration.
Figure 4:
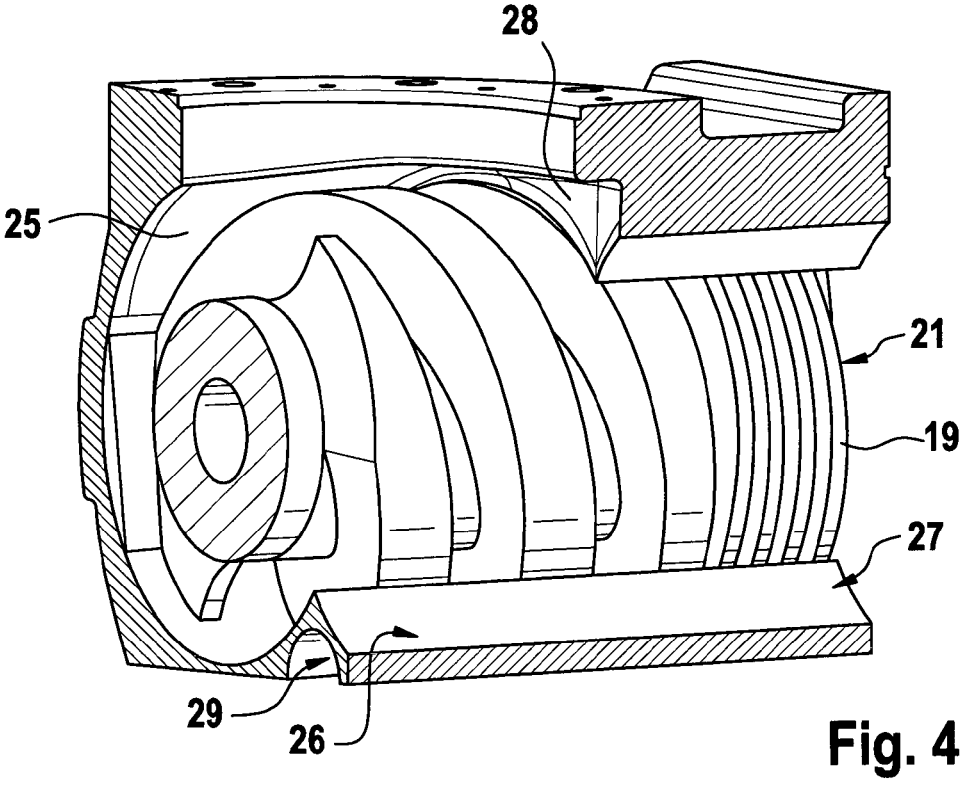
FIG. 4 shows the view from FIG. 3 in another state of the pump.
Figure 5:
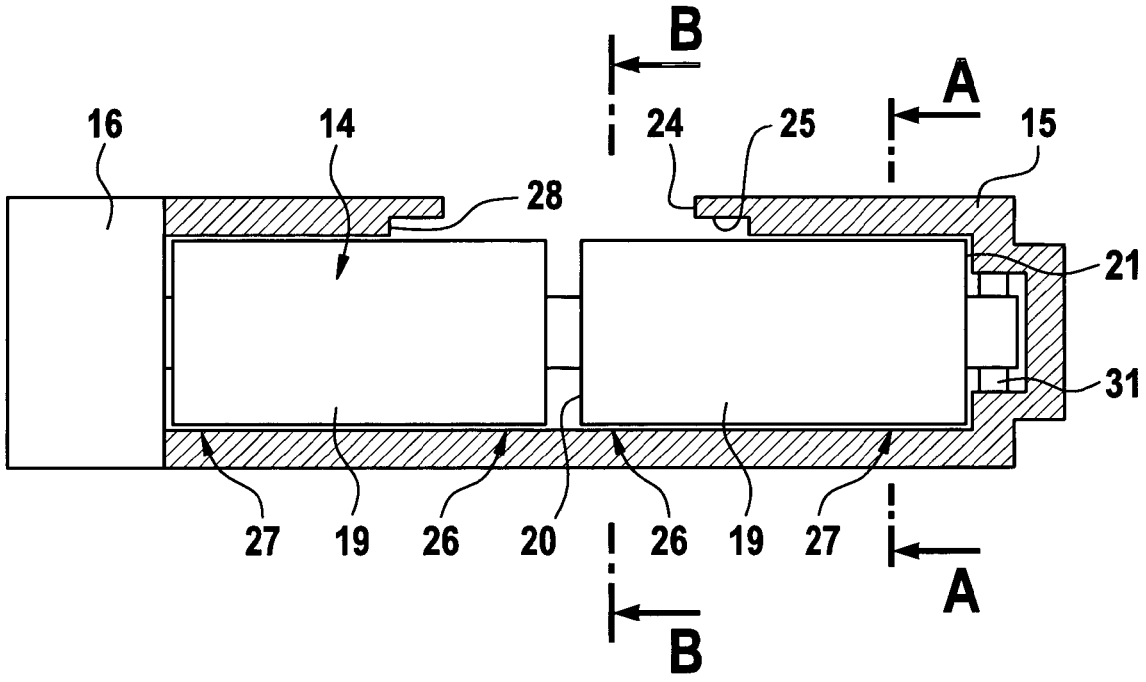
FIG. 5 shows a schematic cross-sectional view of a screw-type pump suitable for the arrangement according to the invention, along an axis of a screw.
Figure 6:
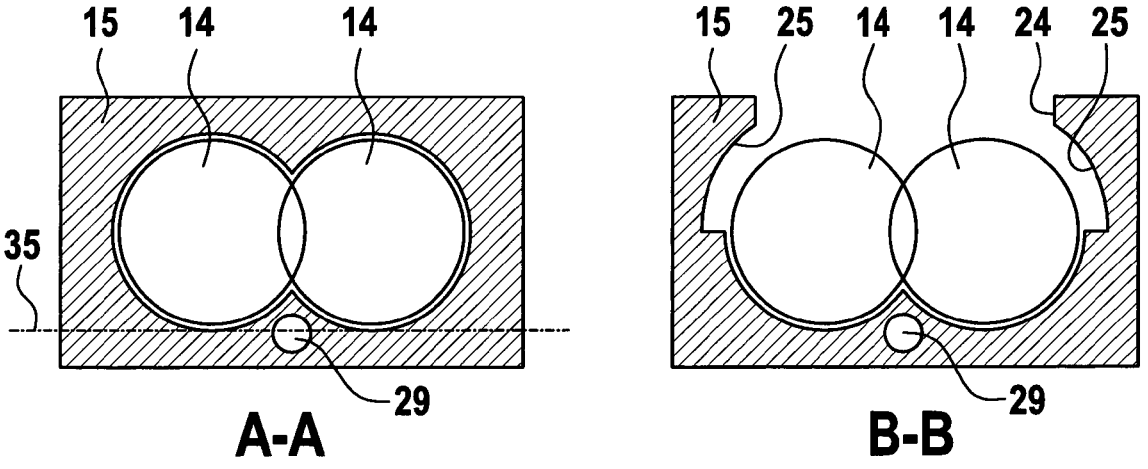
FIG. 6 shows sections along the lines A-A and B-B in FIG. 5.

On the pressure side 21 of the thread 19, the gas is discharged from the working chamber. Through a bore 29 in the pump housing 15, the compressed gas from the pressure sides 21 situated at the outside are brought together to a central outlet opening. The outlet opening (not visible in the figures) is arranged opposite the inlet opening 24. As shown in FIGS. 2, 3 and 5, the bore 29 is integrated into the pump housing 15 and extends between the two screws 14, wherein the line 29 is arranged partially within a tangential plane 35 resting on the two screws 14.

The invention claimed is:

1. A method for evacuating gas from a chamber, wherein a pump arrangement composed of a booster pump and of a downstream forepump is connected to the chamber, having the following steps:

providing a booster pump having two screws, each screw having two threads, each screw having a point symmetry about a longitudinal axis so that the structure of each screw is identical at opposite ends of a diameter passing through said longitudinal axis;

accelerating the booster pump by energizing a drive of the booster pump to accumulate kinetic energy in the booster pump;

introducing the gas from the chamber into the booster pump, such that from the booster pump there is temporarily extracted kinetic energy which exceeds the power provided by the drive of the booster pump, wherein the step of introducing the gas from the chamber into the booster pump includes decelerating the booster pump as a result of temporarily extracting kinetic energy which is imparted to the introduced gas in an initial phase of evacuating the chamber;

delivering the gas to an outlet of the booster pump, wherein the gas is discharged through a bypass valve for as long as an outlet pressure of the booster pump lies above a predefined threshold value and the gas is conducted onward to the forepump when the outlet pressure of the booster pump has fallen below the threshold value; and compressing, by means of the forepump, the gas supplied from the booster pump.

2. The method of claim 1, wherein the booster pump is accelerated with an inlet of the booster pump closed.

3. The method of claim 1, wherein said drive has a drive power and, at its peak, the excess power amounts to at least 50% of the drive power.

4. The method of claim 1, wherein the excess power is extracted during at least 10% of a time required to evacuate gas from the chamber.

5. The method of claim 1, wherein said booster pump has a delivery speed corresponding to a steady state rotational speed of the booster pump at an inlet pressure of 100 mbar and said step of accelerating the booster pump comprises driving said booster pump to a rotational speed at least 30% greater than the delivery speed when gas is introduced from the chamber into the booster pump.

6. The method of claim 1, wherein said predefined threshold value is atmospheric pressure.

7. The method of claim 1, wherein the chamber is a lock chamber which is operated with a cycle time of less than 15 seconds.

8. The method as claimed in claim 7, wherein excess power is extracted from the booster pump during at least 5% of the cycle time of the lock chamber.

9. A pump arrangement for evacuating gas from a chamber, said pump arrangement having a booster pump and having a forepump, wherein an outlet of the booster pump is connected to an inlet of the forepump, said booster pump comprising two screws, each screw having two threads and each screw has a point symmetry about a longitudinal axis so that the structure of each screw is identical at opposite ends of a diameter passing through said longitudinal axis, a bypass valve is arranged between the booster pump and the forepump so that gas from the booster pump is dischargeable without passing through said forepump, and a control unit is configured to output a control signal when a rotational speed of the booster pump lies above a predefined rotational speed threshold value, said control signal indicating that the booster pump is ready for the extraction of kinetic energy from the booster pump wherein temporary extraction of excess kinetic energy results in a reduction of the rotational speed of the booster pump by imparting kinetic energy to gas introduced to the pump during an initial phase of evacuating the chamber.

10. The pump arrangement of claim 9, wherein said booster pump has a delivery speed corresponding to a steady state rotational speed of the booster pump at an input pressure of 100 mbar and the rotational speed threshold value is at least 30% higher than the delivery speed of the pump.

11. The pump arrangement of claim 9, wherein the rotational speed threshold value is higher than 8000 rpm.

12. The pump arrangement of claim 9, wherein the booster pump is a screw-type pump.

13. The pump arrangement of claim 9, wherein said booster pump comprises two screws each having a thread and a housing in which the screws are accommodated, said housing having a first housing portion where there is a suction gap between the housing and threads and a second housing portion where there is a radial minimum spacing between the housing and the thread.

14. The pump arrangement of claim 13, wherein the housing is provided with an inlet opening and wherein the inlet opening is larger than 60% of the cross-sectional area of the thread.

15. The pump arrangement of claim 13, wherein said first housing portion is adjacent an inlet of the booster pump and said second housing portion is downstream of said first housing portion.

* * * * *